US007212115B1

(12) United States Patent
Fawcett

(10) Patent No.: US 7,212,115 B1
(45) Date of Patent: May 1, 2007

(54) TAMPER-PROOF NOOSE SENSOR

(75) Inventor: Christopher J. Fawcett, Charlotte, NC (US)

(73) Assignee: Alpha Security Products, Inc., Charlotte, NC (US)

( * ) Notice: Subject to any disclaimer, the term of this patent is extended or adjusted under 35 U.S.C. 154(b) by 0 days.

(21) Appl. No.: 11/318,823

(22) Filed: Dec. 27, 2005

(51) Int. Cl.
*G08B 13/06* (2006.01)
*G08B 13/12* (2006.01)

(52) U.S. Cl. ..... 340/546; 340/548; 340/568.2; 340/568.4; 340/545.6; 340/568.1; 70/57.1; 70/58

(58) Field of Classification Search ..... 340/546, 340/548, 568.2, 568.4, 568.6; 70/57.1
See application file for complete search history.

(56) References Cited

U.S. PATENT DOCUMENTS 5,072,213 A * 12/1991 Close ..... 340/568.2
5,561,417 A * 10/1996 Rothbaum et al. ..... 340/568.2
6,037,867 A * 3/2000 Joseph et al. ..... 340/508
6,755,055 B2 6/2004 Sedon et al.
7,021,091 B2 4/2006 Leyden et al.
7,081,822 B2 * 7/2006 Leyden et al. ..... 340/635

* cited by examiner

*Primary Examiner*—Donnie L. Crosland
(74) *Attorney, Agent, or Firm*—Sand & Sebolt

(57) ABSTRACT

A security device including a base having a plurality of holes extending therethrough. A noose cable is attached to the base and extends out of the base on one side and passes through the base on another and may be wrapped around merchandise to be secured against theft. A switch is carried by the base and depressed by a lid carried by the base so that when the lid is raised, an alarm will sound. A fastener extends through the lid of the base and secures the noose cable from removable such that when the lid is in the closed position, the head of the fastener is beneath the lid and access to the fastener is prevented. The base is electrically connected to an alarming station in order to provide power to the switch and to provide the alarming function associated with the noose cable security device.

16 Claims, 9 Drawing Sheets

TAMPER-PROOF NOOSE SENSOR

BACKGROUND OF THE INVENTION

1. Technical Field

The present invention relates generally to theft deterrent devices for retail establishments. More particularly, the invention relates to a security device which may pass around or through merchandise to prevent theft thereof. Specifically, the invention relates to a theft deterrent device having a cable to be threaded through openings in an item of merchandise to be secured and which includes sensors to prevent the removal of the theft deterrent device.

2. Background Information

Retail stores have had a difficult time protecting oddly shaped merchandise which may be expensive. Customers often want to visually inspect these expensive articles before deciding to purchase them. The store is thus faced with the problem of how to protect these expensive articles from theft while displaying them for sale.

One method used to protect these packages and the articles contained therein is to enclose the article within a transparent glass display case which can only be accessed by an employee of the retail store. A customer can view the article through the glass, but is not able to handle the article or read any of the information about the article that may be printed thereon. Additionally, the customer is not able to handle the unit to determine its weight, quality or apparent fit, as in the case of a baseball mitt or the like. Much of the merchandise which needs to be secured against theft includes an aperture or hole through which a cable may be woven. Devices have existed in the past, and particularly that disclosed in U.S. Pat. No. 6,755,055 which was developed to secure and EAS tag to merchandise to prevent unauthorized removal while not damaging the item of merchandise. The tag also must also be readily removable by authorized personnel so that the tags do not unduly delay checkout. The prior art product disclosed in the '055 reference includes a cable which may pass through an aperture in a product and be secured to the product thereby. The cable passes into a housing which retains the EAS tag. While this device is appropriate for the purpose for which it is intended, theft deterrent devices have become more sophisticated in a variety of ways. To that end, the need existed for a cable connector which will pass through an aperture formed in merchandise to be secured, but which will electronically connect to an alarming station. Additionally, it is important that the cable connector be locked and sensored in such a way so as to prevent tampering and subsequent removal of the sensor from the merchandise to be secured.

BRIEF SUMMARY OF THE INVENTION

A security device including a base having a plurality of holes extending therethrough. A noose cable is attached to the base and extends out of the base on one side and passes through the base on another and may be wrapped around merchandise to be secured against theft. A switch is carried by the base and depressed by a lid carried by the base so that when the lid is raised, an alarm will sound. A fastener extends through the lid of the base and secures the noose cable from removable such that when the lid is in the closed position, the head of the fastener is beneath the lid and access to the fastener is prevented. The base is electrically connected to an alarming station in order to provide power to the switch and to provide the alarming function associated with the noose cable security device.

BRIEF DESCRIPTION OF THE SEVERAL VIEWS OF THE DRAWINGS

Similar numerals refer to similar parts throughout the drawings.

Figure 1:
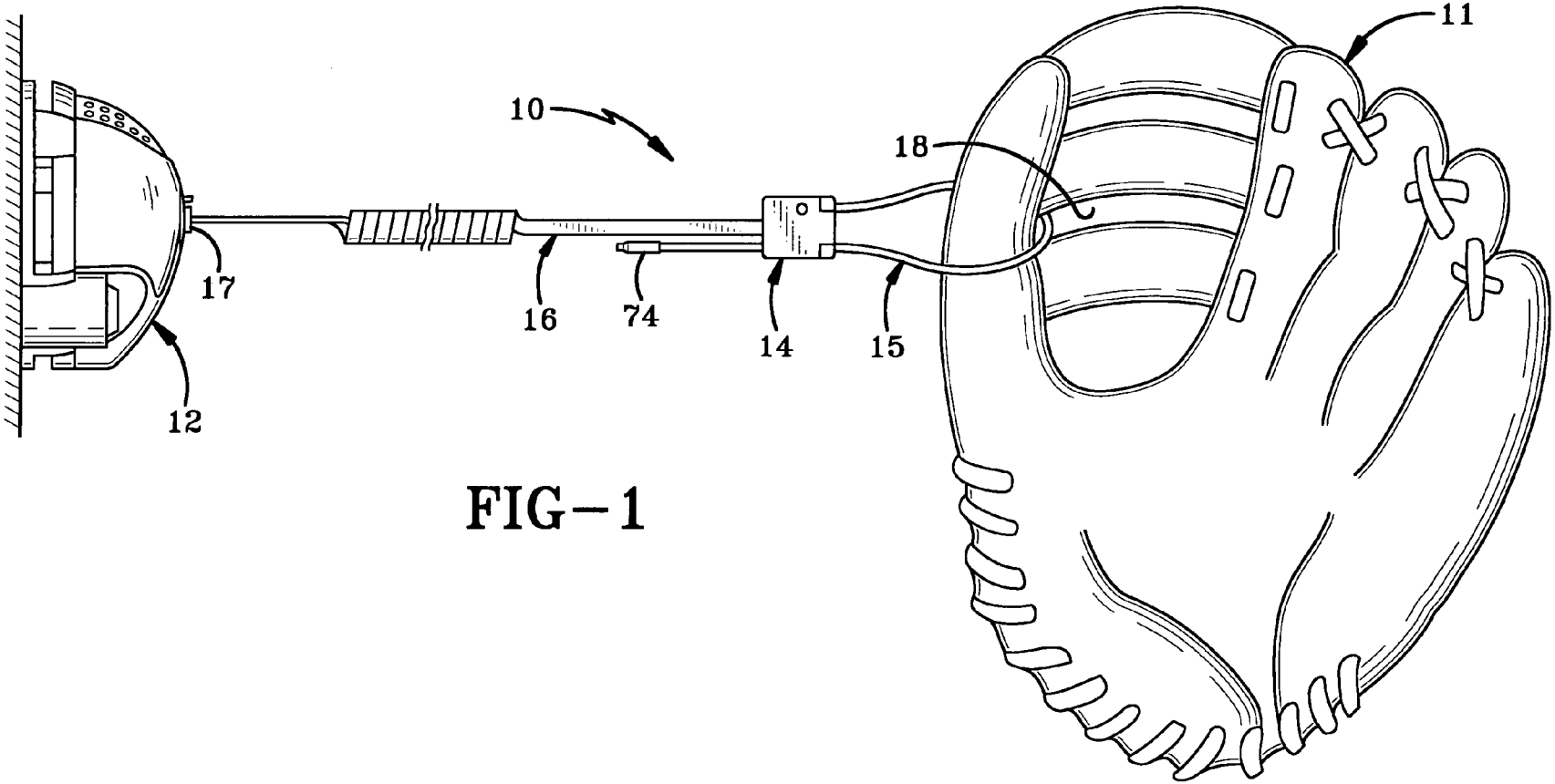
FIG. 1 is a side elevational view of an alarming station and noose connector combination secured to a baseball mitt.
Figure 2:
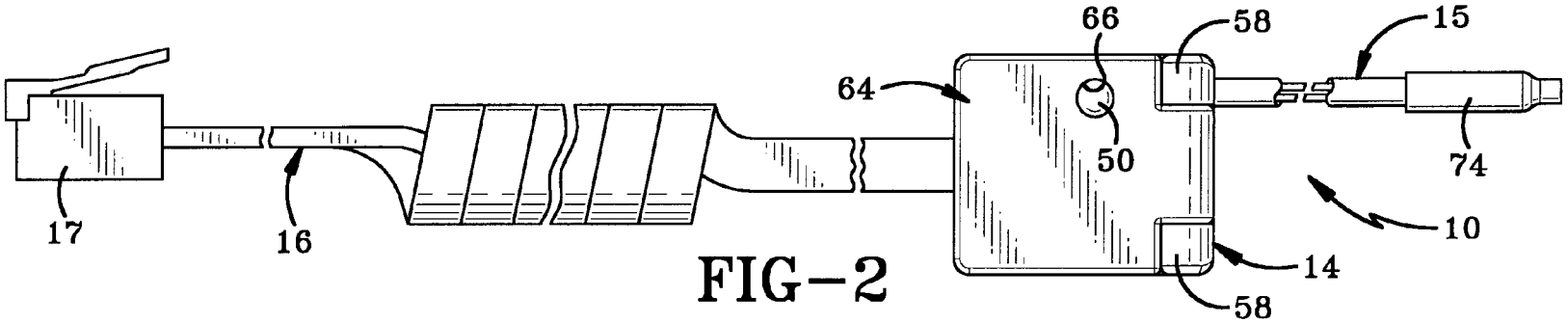
FIG. 2 is a top plane view of the noose connector of the present invention.
Figure 3:
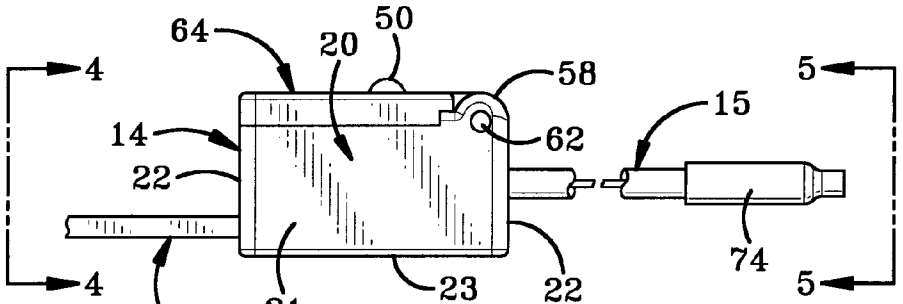
FIG. 3 is a side elevational view of the noose connector of the present invention with pieces cut away.
Figure 6:
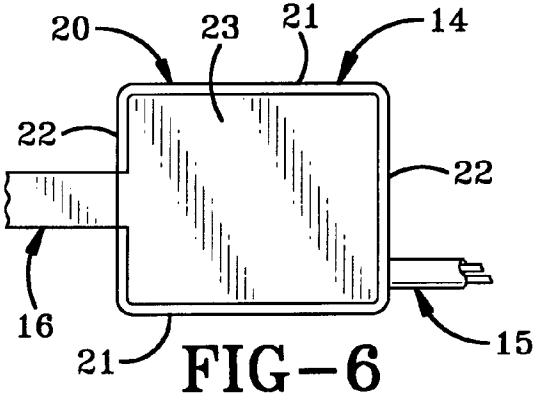
FIG. 6 is a bottom plane view of the noose connector shown in FIG. 2 with portions cut away.
Figure 5:
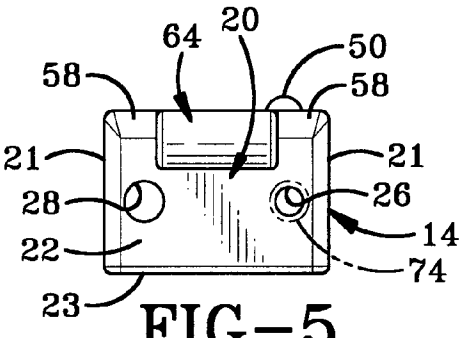
FIG. 5 is a right end elevational view of the noose connector taken along line 55, FIG. 3.
Figure 4:
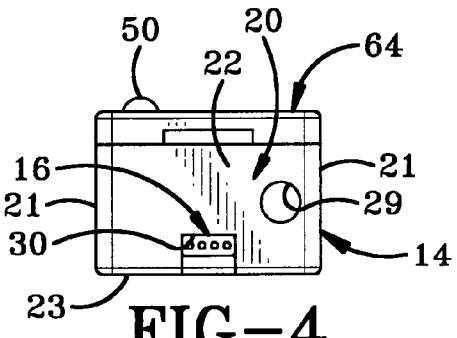
FIG. 4 is a left end elevational view of the noose connector taken along line 44, FIG. 3.
Figure 7:
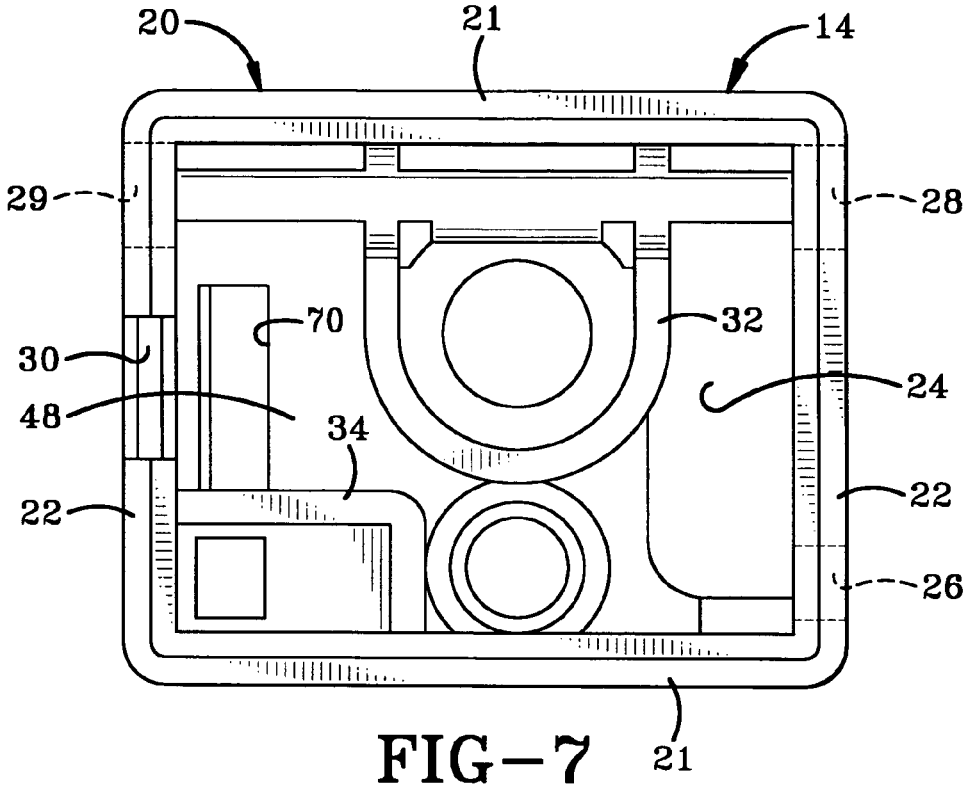
FIG. 7 is a bottom view of the body of the noose connector shown in FIG. 2 with wiring and the bottom wall removed therefrom.

A preferred embodiment of the invention, illustrative of the best mode in which applicant contemplates applying the principles, is set forth in the following description and is shown in the drawings and is particularly and distinctly pointed out and set forth in the appended claims.

DETAILED DESCRIPTION OF THE INVENTION

The theft deterrent device or noose sensor of the present invention is indicated generally by the numeral 10 in the accompanying drawings. Noose sensor 10 is configured to be securely attached to an item of merchandise 11 (such as the baseball mitt shown in the exemplary embodiment of FIG. 1) to deter a shoplifter from stealing merchandise 11. Noose sensor 10 is ordinarily connected to an alarming station 12 such as that which is described in co-pending provisional patent application having Ser. No. 60/644,206, the contents of which are incorporated herein by reference. Noose sensor 10 may also be used to house an EAS tag (not shown) to provide an alarming characteristic for noose sensor 10. Referring more specifically to FIGS. 1–6, noose sensor 10 generally includes a base 14, a noose cable 15, an alarming cable 16 and a removable plug 17. Noose cable 15 is configured to be selectively attachable and removable to base 14. Similarly, plug 17 is configured to be selectively attachable and removable to alarming station 12. In the context of this application, the words "selectively" is defined as meaning that the connection may be repeatedly made and unmade. As such, noose cable 15 is selectively attachable to base 14 so that the user may repeatedly insert and remove noose cable 15 from base 14 to secure merchandise 11 from theft. Similarly, alarming cable 16 by way of plug 17 may be selectively removable or disconnected from alarming station 12 as is necessary for the use of the various elements of the embodiment.

In general, noose sensor 10 is connected to merchandise 11 by threading noose cable 15 through an opening such as opening 18. Noose cable 15 is then bent back upon itself and placed into and through base 14 and is securely retained therein. Plug 17 attached to the free end of alarming cable 16 is then positioned within alarming station 12 to secure noose sensor 10 to the alarming station and to supply power thereto. More particularly referring to drawing 7, base 14 is shown having an outer substantially rectangular perimeter wall 20 having a pair of parallel and spaced apart side walls 21 and a pair of parallel and space apart end walls 22. Side walls 21 and end walls 22 combined with a bottom wall 23 (FIG. 3) to form a substantially rectangular interior cavity 24. A first aperture 26 and a second aperture 28 extend through first end wall 22. There is also a third aperture 29 formed in wall 22. Similarly a notch or recess 30 extends through second end wall 22. The purposes of apertures 26, 28 and 29 and notch 30 will be described in more detail herein below. An arcuately shaped guide block 32 extends upwardly from bottom wall 23 and into interior cavity 24 and is positioned adjacent an L-shaped wall 34 also integrally formed into bottom wall 23 and extending into interior cavity 24.

Figure 8:
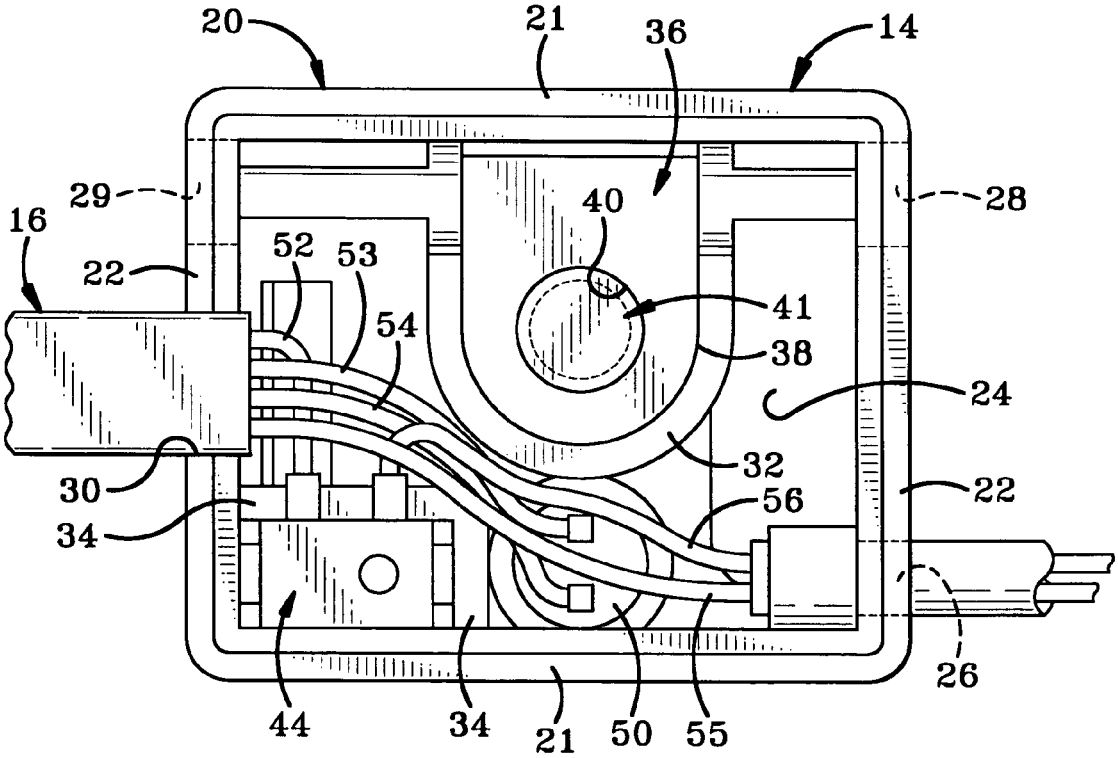
FIG. 8 is a bottom view similar to FIG. 7 with the wiring installed.
Figure 10:
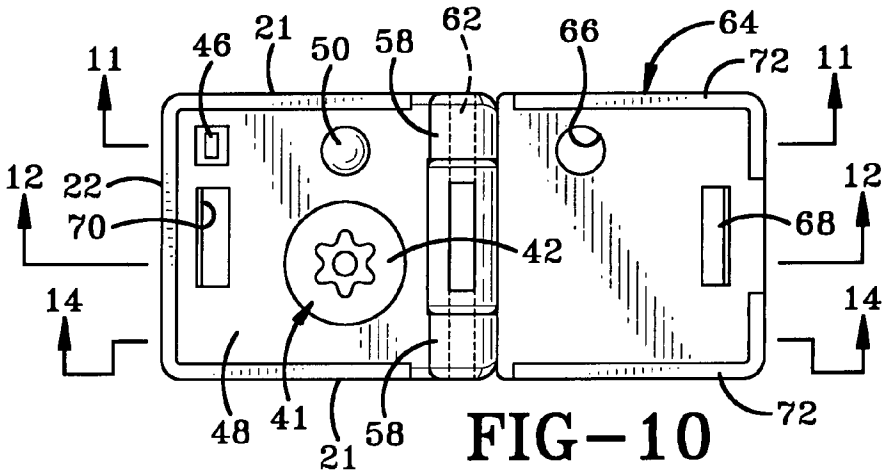
FIG. 10 is a top plane view of the noose connector shown in FIG. 2 with the lid opened and with portions removed.

Turning next to FIG. 8, the electronic elements and movable elements of noose sensor 10 are shown mounted within interior cavity 24. Follower 36 is mounted within guide block 32 and includes a perimeter 38 which is complementarily shaped and sized to be received in a gliding engagement with the perimeter wall of guide block 32. Although follower 36 may have a variety of sizes and shapes in configuration, in the preferred embodiment it includes a pair of parallel and spaced apart side walls which terminate in a semicircular arc which is complementarily shaped in the semicircular arc formed into guide block 32 extending outwardly from top wall 48 and into interior cavity 24. Follower 36 is formed with a threaded aperture 40 and is sized to receive a threaded screw 41 having a torque's head 42 (FIG. 10). The purpose and operation of follower 36 and screw 41 will be described in more detail herein below.

A switch 44 is positioned between perimeter wall 20 and L-shaped wall 34 and is retained securely therein. As shown more particularly in FIG. 11, switch 44 includes an activation button 46 which extends through a top wall 48 of base 14. Bulb 50 is mounted adjacent guide block 32 and extends upwardly through top wall 48.

Alarming cable 16 includes four wires, 52, 53, 54 and 55. Wire 52 extends between alarming cable 16 and switch 44. Wires 53 and 54 extend from alarming cable 16 to bulb 50 and wire 55 extends directly to noose cable 15. One last wire, wire 56 extends from switch 44 to noose cable 15 in order to complete a circuit such that when switch 44 is in the depressed position, the circuit is completed through switch 44 and alarming station 12 will not sound. As also can be seen, there are a number of spaces inside base 14 which would house an EAS tag (not shown) in any convenient way so as to provide an added level of security against the theft of merchandise 11.

Figure 9:
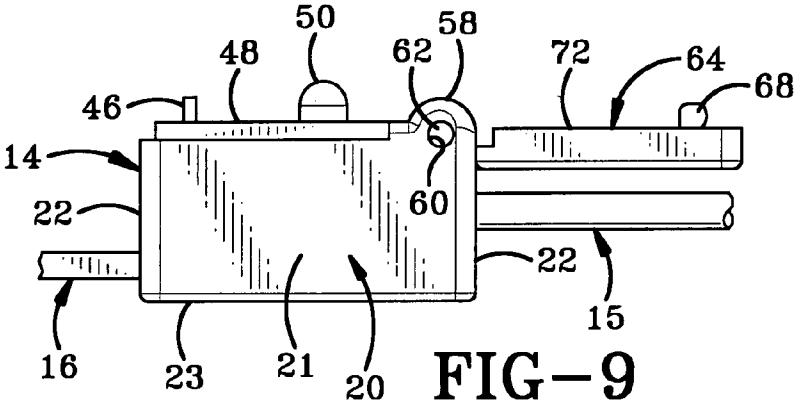
FIG. 9 is a side elevational view of the noose connector shown in FIG. 2 with the lid opened and with portions cut away.
Figure 11:
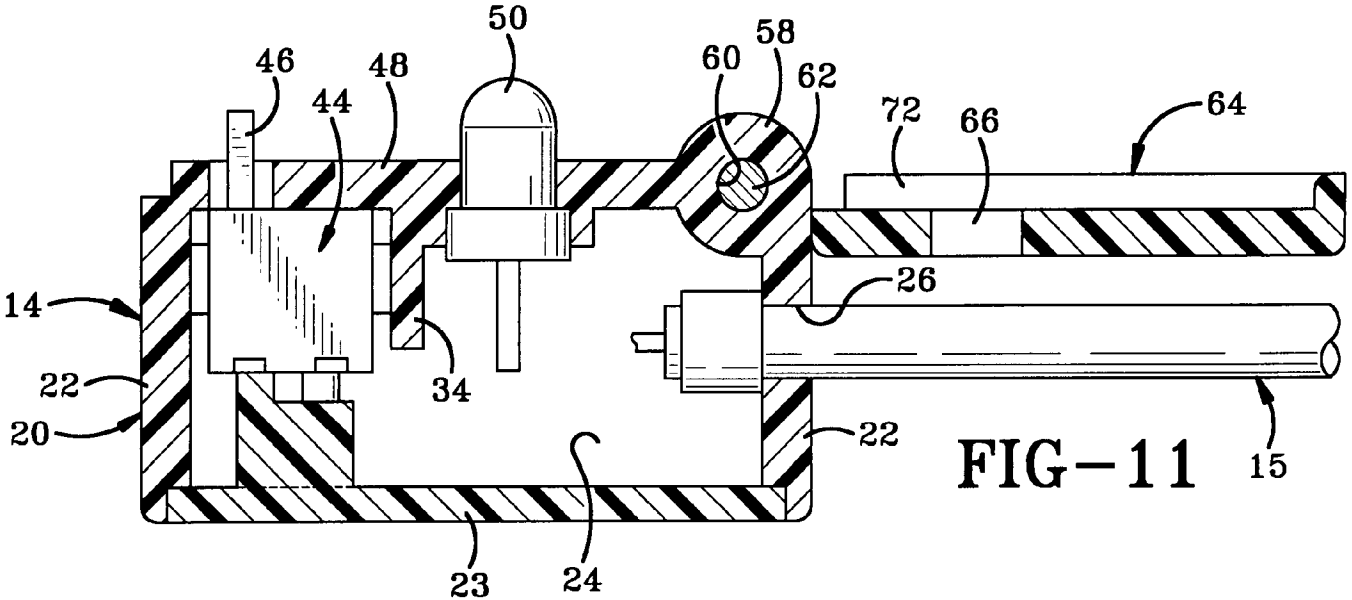
FIG. 11 is a sectional view taken along lines 11—11, FIG. 10.
Figure 12:
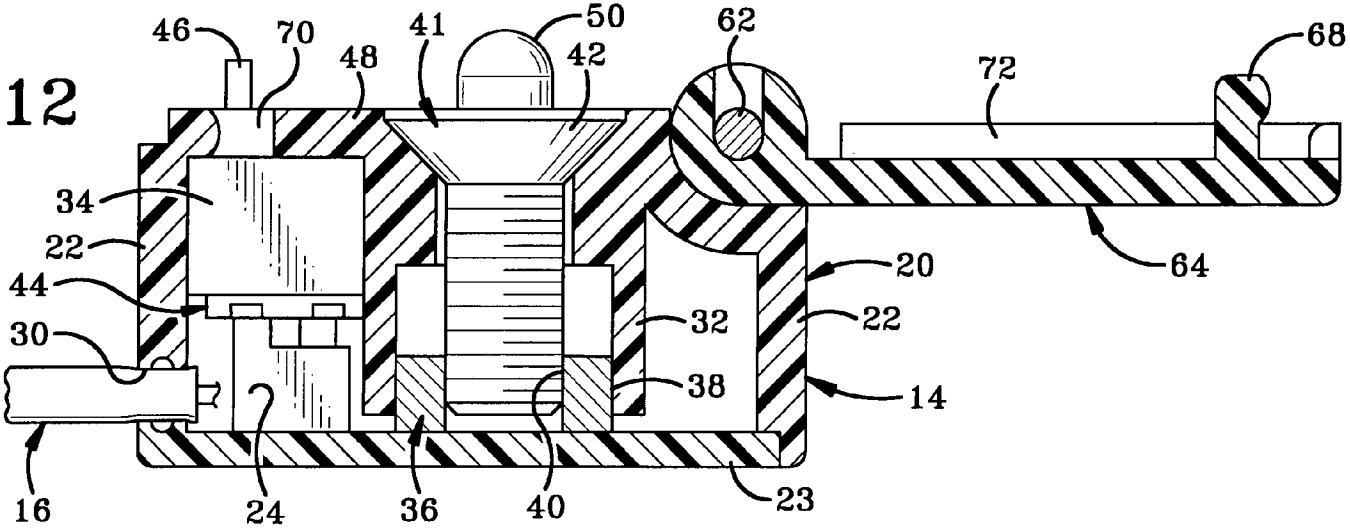
FIG. 12 is a sectional view of the noose connector shown in FIG. 2 with the lid in the open position.

In accordance with the invention and referring next to FIGS. 9–11, top wall 48 of base 14 includes an outwardly extending hinge body 58. Hinge body 58 is formed with a through hole 60 for receiving a hinge pin 62. A lid 64 is hingedly mounted onto hinge pin 62 passing through hole 60 of hinge body 58. Lid 64 includes a hole 66 formed therethrough such that when lid 64 is in the closed position, hole 66 is positioned directly over bulb 50 to assure that light emanating from bulb 50 may shine through hole 66 with lid 64 is in the closed position. Lid 64 also includes a catch 68 which may be received in a catch recess 70 (FIG. 12) as well as a downwardly extending U-shaped perimeter wall 72. Perimeter wall 72 extends downwardly and includes two parallel and spaced apart side walls and one end wall which combine to create a U-shaped perimeter which extends downwardly toward base 14 when lid 64 is in the closed position.

As can be seen from a review of FIGS. 9–12, base 14 is substantially rectangular in configuration, but may take a variety of sizes and shapes without departing from the spirit of the present invention. Additionally, we note that screw 41 includes a torque type head on the top portion thereof, but a variety of head types may be utilized without departing from the spirit of the present invention. Noose cable 15 may have a variety of lengths and widths in order to fit through and around products of different sizes and shapes, but as a general rule will include a terminator 74 on the free end thereof which terminator is sized to fit through holes 28 and 29 in both end walls 22 of base 14.

Figure 14:
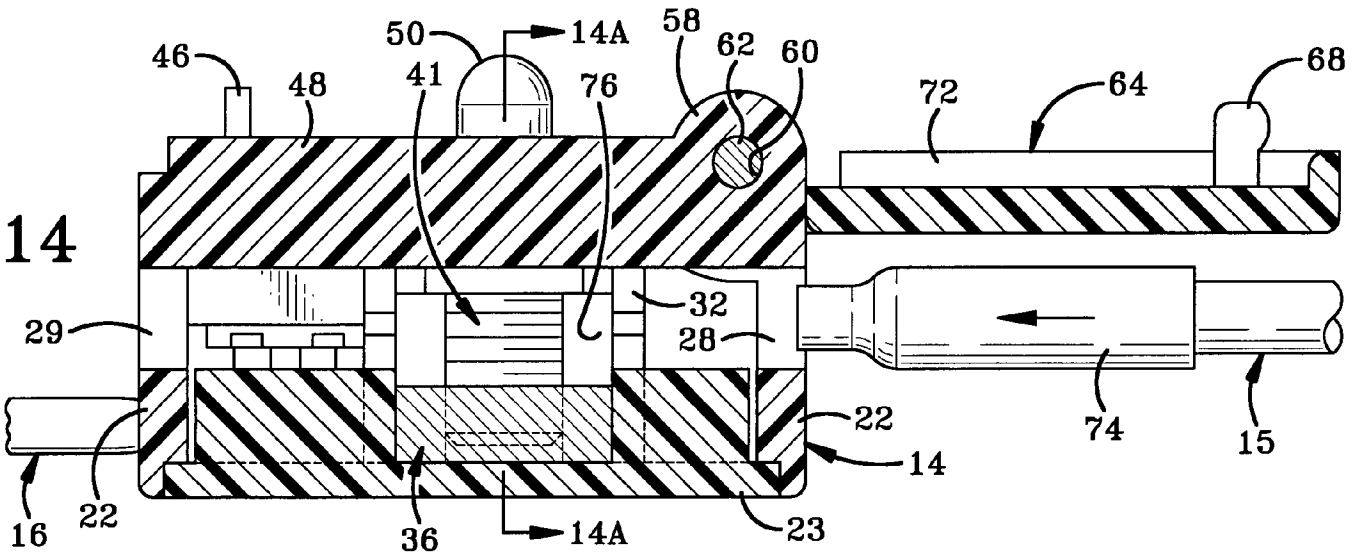
FIG. 14 is a sectional view taken along line 14—14, FIG. 10.
Figure 13:
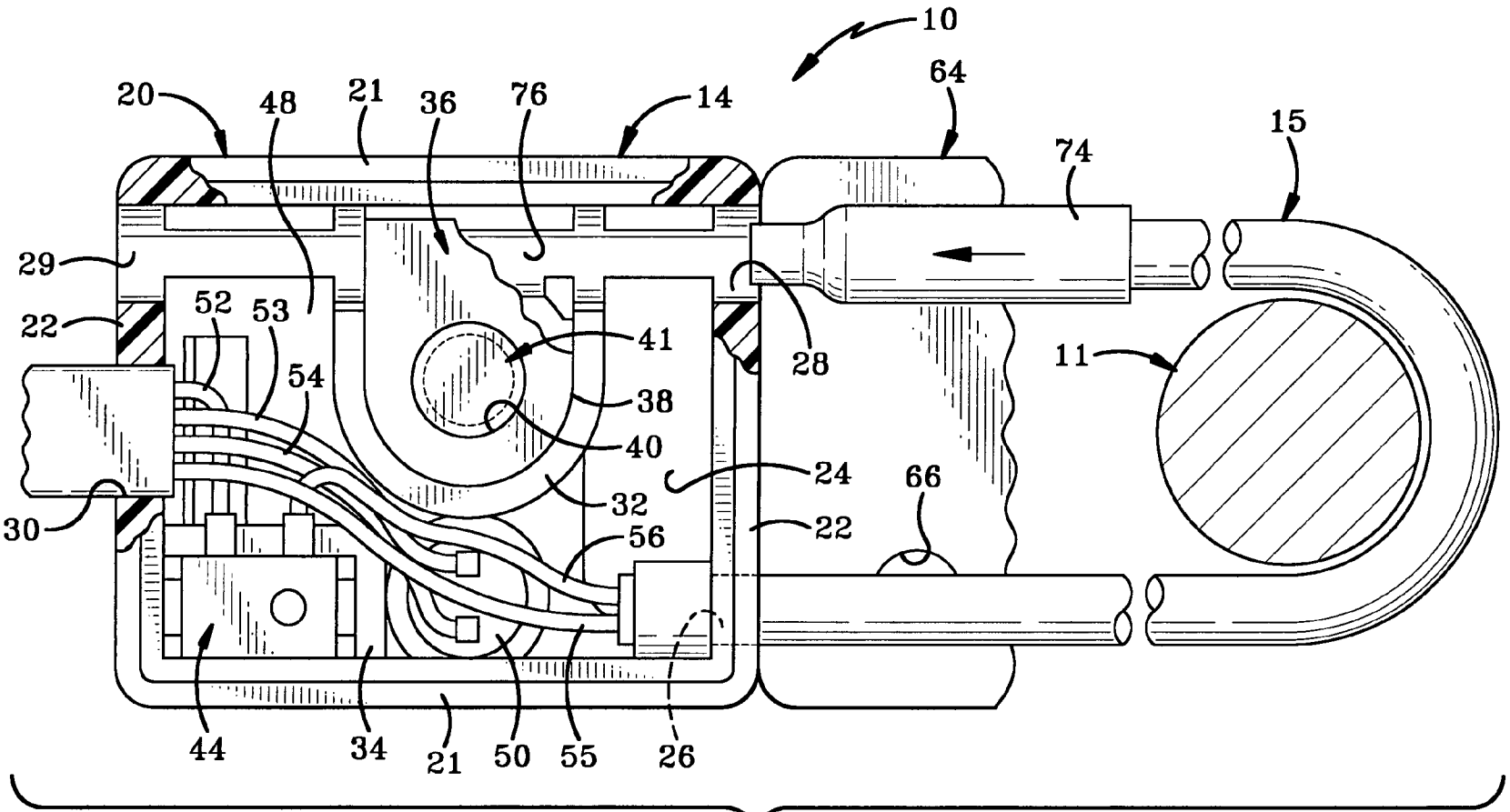
FIG. 13 is a bottom plane view of the noose connector of the present invention shown with the cable partially inserted into the noose connector body and with portions cut away.
Figure 14A:
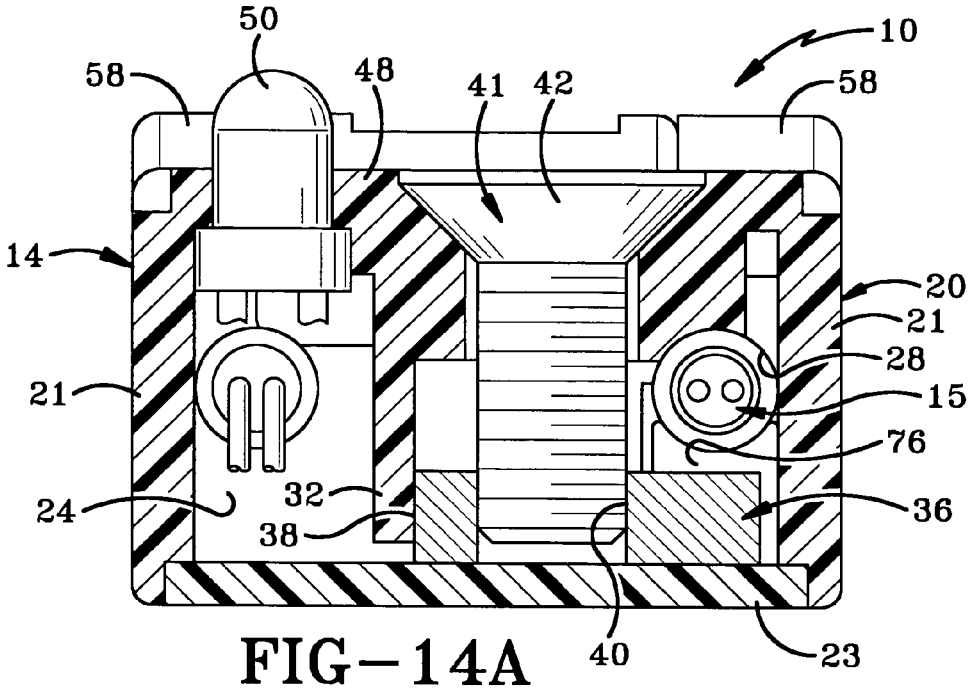
FIG. 14*a* is a sectional view taken along line 14*a*—14*a*, FIG. 14.
Figure 16A:
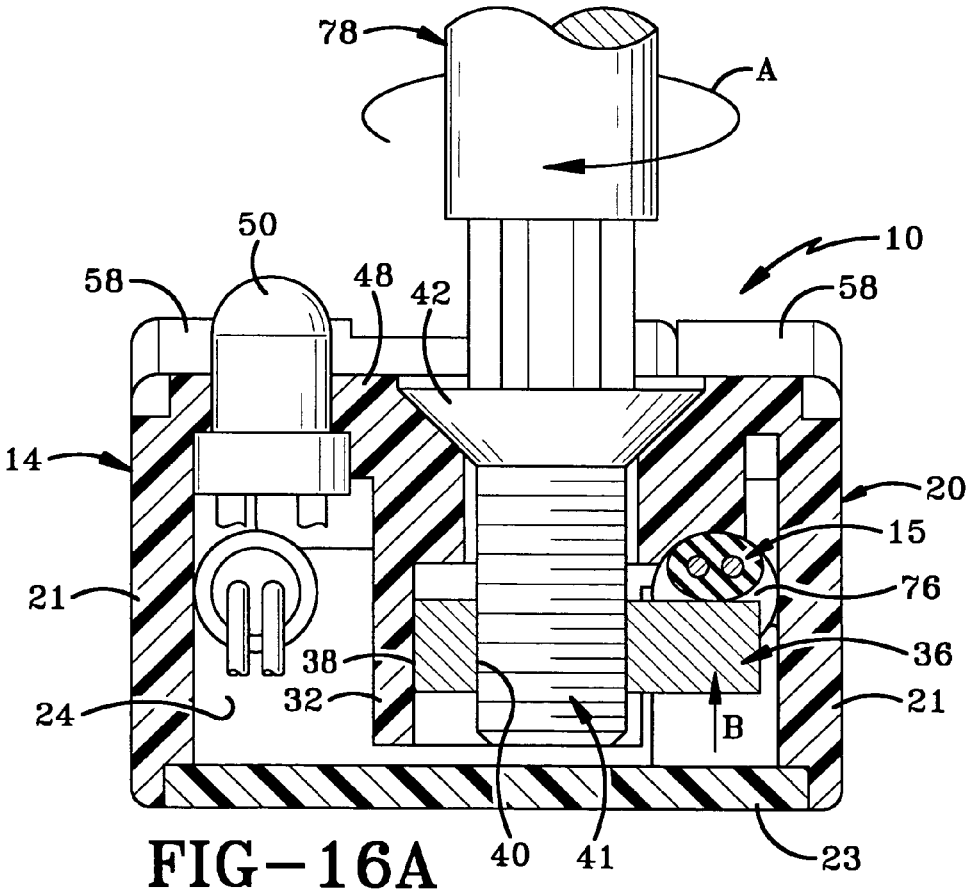
FIG. 16*a* is sectional view taken along line 16*a*—16*a*, FIG. 16.
Figure 15:
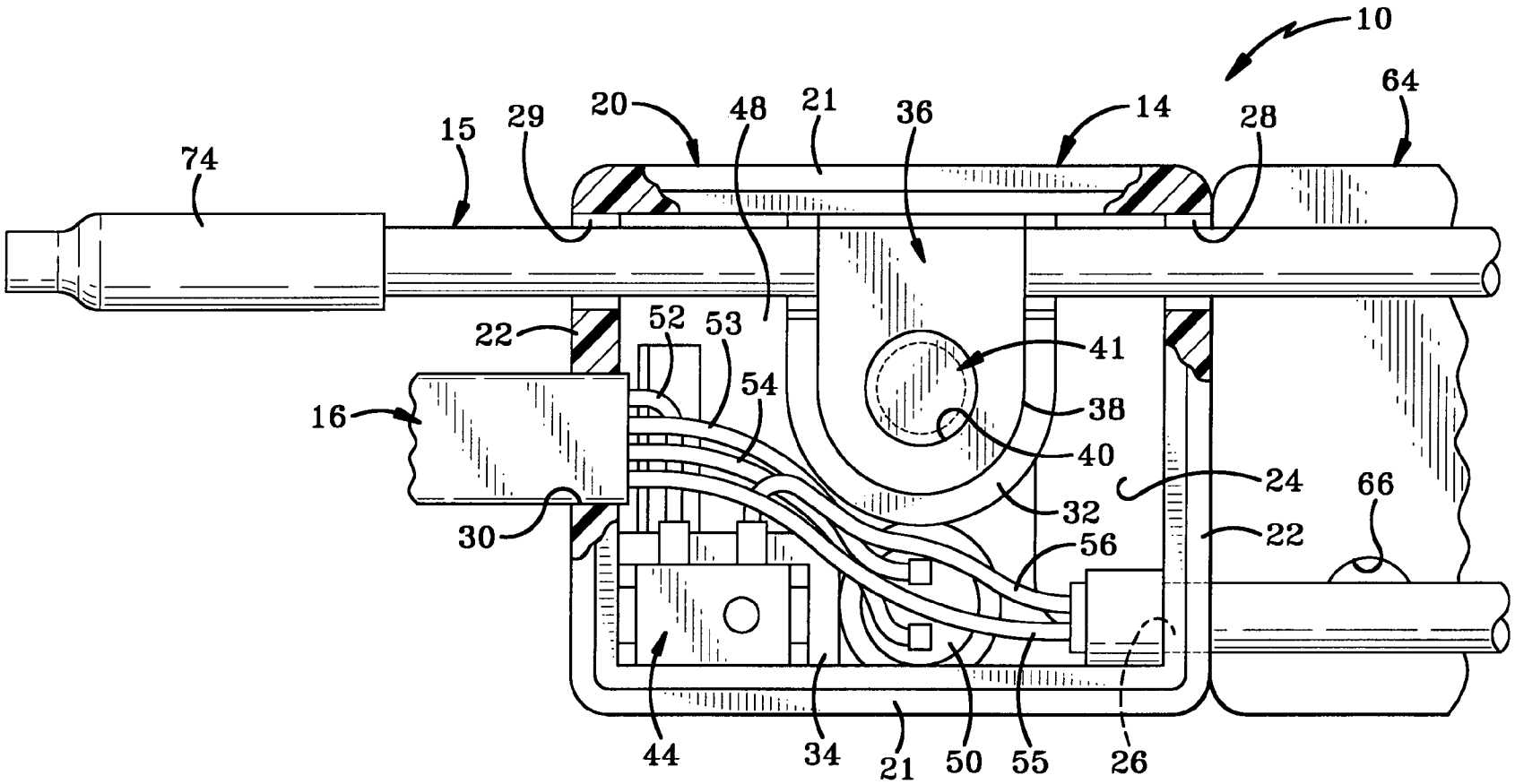
FIG. 15 is a side elevational view similar to FIG. 13 with a bottom plane view similar to FIG. 13 with portions broken away and in section showing the cable received through the body of the noose sensor.
Figure 16:
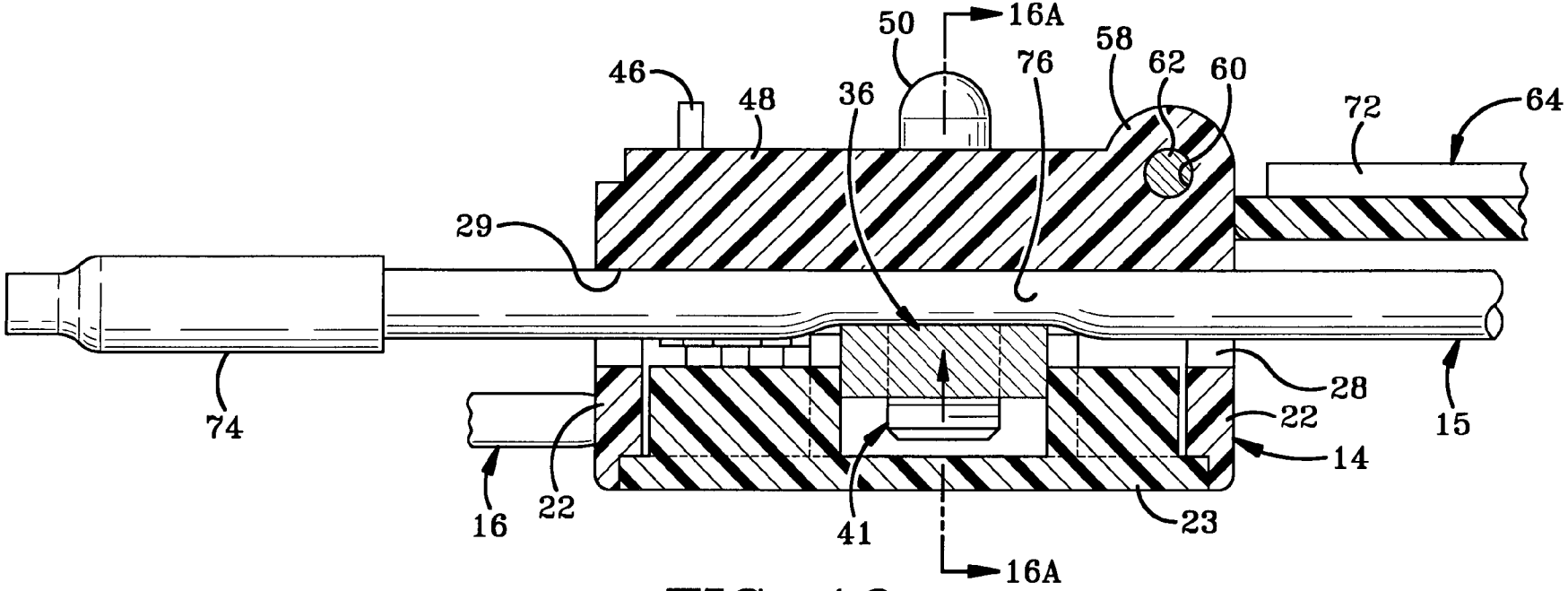
FIG. 16 is a side elevational view with portions cut away and in section of the noose connector shown in FIG. 15.

The first step of the operation of noose sensor 10 is shown more particularly in FIGS. 13–14*a*. Noose cable 15 exits end wall 22 of base 14 by way of first aperture 26 and passes around or through a piece of merchandise 11. Terminator 74 of noose cable 15 is then positioned adjacent second aperture 28. Second aperture 28 is of a diameter sufficient to allow enlarged terminator 74 as well as noose cable 15 to pass therethrough. At this point in operation, lid 64 is in the open position and a screwdriver or the like has been used on screw 41 to rotate screw 41 in such a manner that follower 36 is moved to the lower most position such as that shown in FIGS. 14 and 14*a*. Top wall 48 and follower 36 form a space 76 adjacent second aperture 28 such that noose cable 15 may pass through second aperture 28 and directly into space 76 above follower 36 and beside screw 41. Noose cable 15 is then pushed entirely through base 14 and out of third aperture 29. Noose cable 15 of noose sensor 10 is now in the position shown in FIG. 15. Referring next to FIGS. 16 and 16*a*, a screwdriver 78 is put into contact with torque's head 42 of screw 41 and rotated in the direction of arrow A. As screw 41 is rotated, follower 36 cams up the threads formed on screw 41 and rotation of follower 36 is prevented because of its complementarily shape with guide block 32. Follower 36 moves in the direction of arrow B and compresses noose cable 15 within space 76 adjacent top wall 48. The interaction of follower 36 and noose cable 15 is shown particularly in FIG. 16 where the cable is shown in an exaggerated way, to be slightly deformed as a result of this pinching action. The movement of follower 36 thus prevents the withdrawal of noose cable 15 from base 14. Even more appropriately, terminator 74 is larger than the relatively small space created by the movement of follower 36 and as such any movement which may occur of noose cable 15 from tugging and pulling thereon, would never allow terminator 74 to slide therethrough thereby securing merchandise 11 from theft. Once screw 41 has been rotated and noose cable 15 is in the lock position by way of follower 36, alarming cable 16 may be attached to alarming station 12 by way of plug 17.

In accordance with one of the main features of the present invention, lid 64 may now be moved to the close position where catch 68 is moved into catch recess 70 to latch lid 64 in the closed position. In accordance with the present invention, once in the closed position, lid 64 will maintain pressure on actuation button 46 of switch 44 thereby depressing the same and completing the circuit traveling through wires 55 and 56. So long as this circuit remains completed, bulb 50 will stay lit and no alarm will sound. However, in accordance with one of the features of the present invention, if lid 64 is moved to the open position, actuation button 46 will raise causing a disconnect in the circuit from alarming station 12 to noose cable 15 thereby causing alarming station 12 to alarm.

As can be seen from a review of the drawings and the above discussion, lid 64 entirely covers torque's head 42 of screw 41 when in the closed position. By covering screw 41 with lid 64, the invention assures that there is no access to screw 41 to allow the removal thereof. Additionally, inasmuch as lid 64 is alarmed when in the closed position by way of actuator button 46 of switch 44, the would-be thief would not be able to raise lid 64 to gain access to screw 41 without triggering alarm station 12. Inasmuch as actuator 46 and lid 64 prevent access to screw 41, the screw cannot be unscrewed such that noose cable 15 may be removed from base 14 to free merchandise 11 and allow the theft thereof.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A security device comprising:

a base formed with first and second apertures;

a lid mounted on the base movable between open and closed positions;

a switch located within the base which is activated when the lid is moved from one of the open and closed positions to the other of the open and closed positions and which will sound an alarm when the switch is tripped;

a noose cable having first and second ends, said first end being relatively fixed to the base, said second end sized to pass through the first and second apertures formed in the base to form an adjustable loop for placement about an object to be protected by the security device; and a fastener located within an access area of the base to permit adjustment of the size of the loop and forming an adjustable space adjacent the fastener and below the lid through which the cable passes to trap the cable in the base upon rotation of the fastener, said fastener having a head positioned below the lid when the lid is in the closed position.

2. The security device as defined in claim 1 wherein a follower operatively engages the fastener and forms the adjustable space for trapping the cable in the base upon rotation of the fastener.

3. The security device as defined in claim 2 wherein a terminator is mounted on the second end of the cable, said terminator having a diameter larger than the diameter of the cable but sized to pass through the first and second apertures; and in which the space adjacent the follower can be sized upon rotation of the fastener to permit free movement of the cable therethrough while preventing movement of the terminator through said space.

4. The security device as defined in claim 1 further comprising an activation button connected to the switch in operational contact with the lid when the lid is in the closed position.

5. The security device as defined in claim 4 in which the lid is hingedly mounted on the base at one end.

6. The security device as defined in claim 5 further comprising a catch formed on the lid, and a mating recess formed in base such that the catch engages the recess when the lid is in the closed position.

7. The security device as defined in claim 6 in which the lid includes a perimeter wall extending toward the base.

8. The security device as defined in claim 4 further comprising an alarm electronically connected to the switch such that when the switch is tripped, the alarm will sound.

9. The security device as defined in claim 8 further comprising a top wall formed on the base, and which the activation button extends adjacent the top wall, and in which the lid will depress the actuation button when in the closed position.

10. The security device as defined in claim 9 in which the switch is carried by the base below the top wall and in which the activation button extends through the top wall.

11. The security device as defined in claim 10 in which the fastener is a screw, and in which the screw extends through the top wall and threadably engages the follower, and in which the noose cable extends through the first and second apertures of the base below the top wall.

12. The security device as defined in claim 1 in which the screw head is a torque type head.

13. The security device as defined in claim 1 further comprising:

an alarming station; and an alarming cable extending from the alarming station to the base and in which the alarming cable is electrically connected to the switch such that when the switch is tripped, the alarm will sound.

14. The security device as defined in claim 13 in which the alarming cable is electrically connected to the noose cable whereby when the noose cable is cut, the alarm will sound.

15. The security device as defined in claim 14 in which the switch is electrically connected to the noose.

16. The security device as defined in claim 15 further comprising a light bulb electrically connected to the alarming cable whereby the light remains illuminated when the lid is in the closed position.

* * * * *